US010170240B2

(12) United States Patent
Baumann et al.

(10) Patent No.: US 10,170,240 B2
(45) Date of Patent: Jan. 1, 2019

(54) METHOD FOR FORMING A FRAME CORE HAVING A CENTER LEG FOR AN INDUCTIVE COMPONENT AND FRAME CORE PRODUCED ACCORDINGLY

(71) Applicant: SUMIDA COMPONENTS & MODULES GMBH, Obernzell (DE)

(72) Inventors: Michael Alfons Baumann, Passau (DE); Martin Grubl, Untergriesbach (DE)

(73) Assignee: Sumida Components & Modules GMBH, Obernzell (DE)

( * ) Notice: Subject to any disclaimer, the term of this patent is extended or adjusted under 35 U.S.C. 154(b) by 210 days.

(21) Appl. No.: 15/317,104

(22) PCT Filed: Jun. 10, 2015

(86) PCT No.: PCT/EP2015/062893
§ 371 (c)(1),
(2) Date: Dec. 7, 2016

(87) PCT Pub. No.: WO2015/189245
PCT Pub. Date: Dec. 17, 2015

(65) Prior Publication Data

US 2017/0110245 A1 Apr. 20, 2017

(30) Foreign Application Priority Data

Jun. 11, 2014 (DE) ..... 10 2014 211 116

(51) Int. Cl.
*H01F 3/08* (2006.01)
*H01F 3/14* (2006.01)
(Continued)

(52) U.S. Cl.
CPC ..... *H01F 41/0246* (2013.01); *B28B 1/24* (2013.01); *B28B 3/00* (2013.01); *B28B 7/16* (2013.01);
(Continued)

(58) Field of Classification Search
None
See application file for complete search history.

(56) References Cited

U.S. PATENT DOCUMENTS 3,548,492 A 12/1970 Weber
4,320,080 A 3/1982 Esper et al. ..... 264/111
(Continued)

FOREIGN PATENT DOCUMENTS

CN 1866420 11/2006
CN 101183604 5/2008
(Continued)

OTHER PUBLICATIONS

Action dated Aug. 18, 2017 in corresponding Chinese application 2015800313403, with English translation, 18 pages.
(Continued)

*Primary Examiner* — Mary Lynn F Theisen
(74) *Attorney, Agent, or Firm* — Fattibene and Fattibene LLC; Paul A. Fattibene

(57) ABSTRACT

The present invention provides a method of forming a frame core (1) having a center leg (3) for an inductive component, and an accordingly formed frame core (1) having a center leg (3) and an air gap (4) in the center leg (3). The frame core (1) is formed integrally with the center leg (3), the air gap (4) being molded into the center leg (3) during the formation of the frame core (1).

13 Claims, 4 Drawing Sheets

Figure 1:
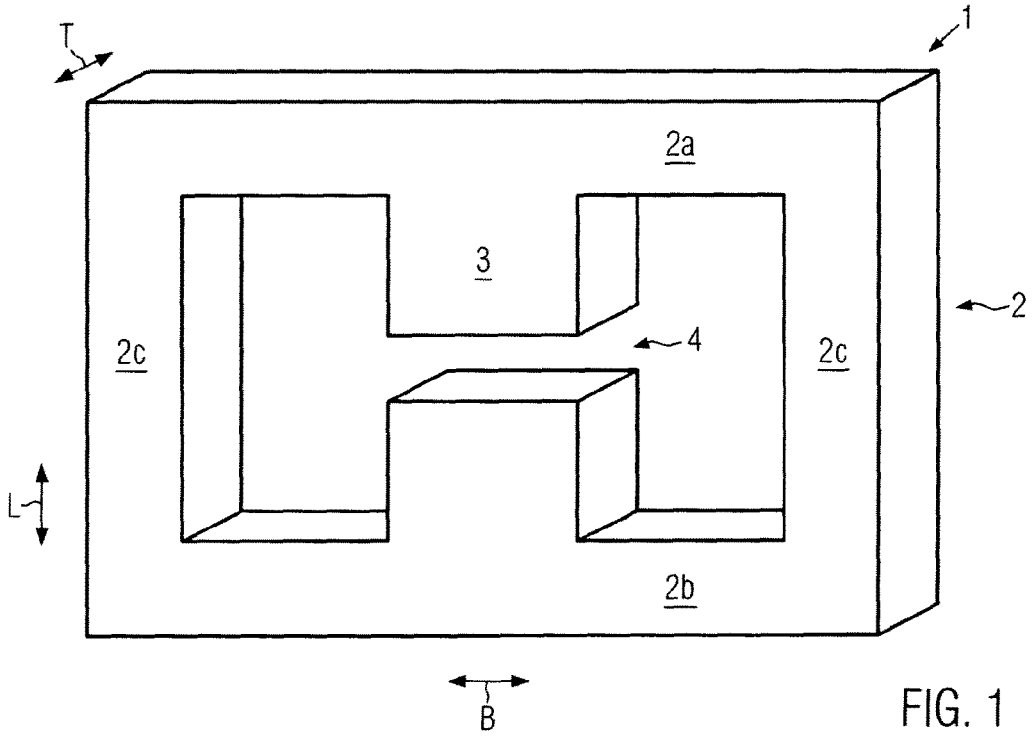

(51) Int. Cl.

| | |
|---|---|
| ***H01F 41/02*** | (2006.01) |
| ***H01F 27/255*** | (2006.01) |
| ***B28B 1/24*** | (2006.01) |
| ***B28B 3/00*** | (2006.01) |
| ***B28B 7/18*** | (2006.01) |
| ***B28B 7/16*** | (2006.01) |

(52) U.S. Cl.
CPC ..... *H01F 3/08* (2013.01); *H01F 3/14* (2013.01); *H01F 27/255* (2013.01)

(56) References Cited

U.S. PATENT DOCUMENTS

| | | | | |
|---|---|---|---|---|
| 4,853,668 | A * | 8/1989 | Bloom | H01F 27/255 336/214 |
| 5,319,343 | A | 6/1994 | Jeffries | 336/181 |
| 9,620,277 | B2 * | 4/2017 | Grubl | H01F 27/255 |
| 2006/0238288 | A1 | 10/2006 | Watanabe | 336/212 |
| 2008/0074230 | A1 | 3/2008 | Chen et al. | 336/212 |
| 2014/0266535 | A1 * | 9/2014 | Willis | H01F 27/24 336/178 |
| 2015/0123402 | A1 * | 5/2015 | Wagoner | H01F 3/14 290/44 |
| 2017/0040097 | A1 * | 2/2017 | Wee | H01F 27/00 |

FOREIGN PATENT DOCUMENTS

| | | |
|---|---|---|
| CN | 201311811 | 9/2009 |
| CN | 102360863 | 2/2012 |
| CN | 202473480 | 10/2012 |
| DE | 2 305 958 | 8/1974 |
| DE | 81 32 269 | 11/1985 |
| EP | 1193119 | 5/1965 |
| EP | 0 004 272 | 10/1979 |
| EP | 0 388 930 | 9/1990 |
| EP | 0472151 | 2/1992 |
| EP | 102004008961 | 9/2005 |
| GB | 960045 | 6/1964 |
| JP | S57132308 | 8/1982 |
| JP | S57193015 | 11/1982 |
| JP | S60-132309 | 7/1985 |
| JP | S60254716 | 12/1985 |
| JP | H04-10308 | 1/1992 |
| JP | H04-296009 | 10/1992 |
| JP | H06246724 | 9/1994 |
| JP | H 10-199741 | 7/1998 |
| JP | H10199741 | 7/1998 |
| JP | 2013216501 | 10/2013 |

OTHER PUBLICATIONS

Action dated Feb. 6, 2018 in corresponding Japanese application 2016-572486, with English translation, 9 pages.
Examination report dated Feb. 24, 2015 in the corresponding German Application No. 10 2014 211 116.1.
Chinese Office Action dated Jul. 24, 2018 in corresponding Chinese patent application No. 2015800313403 and English Translation, 14 pages.
Action believed dated Sep. 25, 2018 in corresponding Japanese application 2016-572486, 5 pages.

* cited by examiner

METHOD FOR FORMING A FRAME CORE HAVING A CENTER LEG FOR AN INDUCTIVE COMPONENT AND FRAME CORE PRODUCED ACCORDINGLY

FIELD OF THE INVENTION

The present invention relates to a method for forming a frame core having a center leg for an inductive component and to an accordingly formed frame core having a center leg, wherein the frame core is formed integrally with the center leg and an air gap is molded into the center leg.

BACKGROUND

In inductance coils and transformers, magnetic cores according to an E core configuration or an E-I core configuration or a double-E core configuration are often used. The center leg of these magnetic cores has normally arranged thereon at least one winding. When a magnetic core according to an E-I core configuration is manufactured, an E core is combined with an I core. When a magnetic core according to a double-E core configuration is manufactured, two individual E cores are normally joined by gluing. Alternatively, frame cores are used together with I cores, the I core being then inserted as a center leg into the frame core and joined to two opposed sides of the frame core by gluing.

In the case of E cores, air gaps can be adjusted in grinding processes with very small manufacturing tolerances for the purpose of avoiding saturation influences, so that the $A_L$ value of a magnetic core can be adjusted by precise grinding. It is true that the winding process of these magnetic cores is not very complicated, since the coil to be wound has no core and is coupled to the core only during the assembly process, but joining two E core halves in a separate gluing process is highly disadvantageous. The disadvantage resides, on the one hand, in that the glued joint leads to a significant weak point in the finished component and, on the other hand, in that the gluing process represents a considerable cost and time factor in the production process. In addition, the two E core halves are separately molded in a molding press in the production process and are then removed from the moldings press. Subsequently, the two E core halves are sintered individually in two separate sintering processes. All this results in complicated handling for conventional production processes. Furthermore, due to the inevitable manufacturing tolerances occurring during sintering, it can no longer be guaranteed for two individually sintered core parts that the core formed by combining the two core parts is produced with the desired accuracy and, in particular, that the outer legs of two E core halves are arranged in plane-parallel opposed relationship with one another.

In addition, the manufacturing tolerances occurring in the sintered core halves result in a displacement at the transition from one core half to the next, when two E core halves that have been produced in this way are assembled. The resultant locations of displacement in the finished core represent for the magnetic field lines in the finished inductive component a constriction of the magnetically effective core cross-section. At said constriction, premature saturation of the core occurs and leads to a decrease in inductance. Furthermore, the field lines exit the ferrite area at saturation regions and saturation gaps during operation in the finished inductive component, so that additional losses will occur in the winding.

The frame core admittedly has the advantage that the core is produced from one piece and does therefore not necessitate any subsequent gluing process, a circumstance which leads to a significantly increased mechanical stability in comparison with glued core configurations and which, due to the non-existing gluing process, also leads to a simple production process, but it is here much more difficult to efficiently form air gaps in a frame core. For this reason, frame cores are excluded from many power applications.

Reference DE 10 2004 008 961 B1 describes a frame core with a center leg glued into said frame core.

Document DE 1 193 119 describes a framelike core component with a tuning pin inserted in a semi-cylindrical recess of the framelike core component.

Reference EP 004272 A2 discloses a method of manufacturing magnetic cores from molding material with soft-magnetic properties by molding a mixture of soft-magnetic material and a synthetic resin as a binder, a mixture of iron powder being here mixed with a thermosetting resin in liquid form and filled into a heated mold and then molded.

Reference DE 3909624 A1 describes an E-I core with an air gap, the air gap being formed in the I part of the core by means of molding.

Reference DE 2305958 A discloses a bipartite magnetic core with a sheared hysteresis loop, said magnetic core being sheared in an air gap-free manner by a solid non-magnetic or low-permeable body and the parts of the magnetic core being firmly interconnected, partially as directly as possible and partially via the body with a sheared hysteresis loop.

SUMMARY OF THE INVENTION

In view of the above-mentioned problems, it is an object of the present invention to manufacture a mechanically stable magnetic core in a simple manufacturing process, the manufactured magnetic core being adapted to be used in a wide range of power applications.

The above-mentioned object is achieved by a method for forming a one-piece frame core according to one embodiment and by a frame core according to another embodiment. Advantageous further developments of the method are defined in the additional embodiments. Advantageous further developments of the frame core are defined in the additional embodiments.

According to an illustrative embodiment of the present invention, a method is provided, according to which a one-piece frame core having a center leg is formed, and an air gap is molded into the center leg during the formation of the frame core. The method according to the present invention provides a frame core having a center leg and an air gap in the center leg, without core-to-core gluing and grinding processes for producing an air gap being necessary. A mechanically stable core with small manufacturing tolerances is thus produced and core displacement is normally avoided, whereby the EMV behavior is improved. In addition, a grinding tolerance, which is required for double-E cores, need not be provided according to the present invention, whereby ferrite material is saved. The reduced amount of ferrite material also allows saving furnace capacity.

According to another more advantageous embodiment thereof, the frame core is formed in a ceramic injection molding process. Alternatively, the frame core having a center leg is formed in a compression molding process. In both cases, a simple, fast and cost-efficient production is obtained.

According to another more advantageous embodiment of the present method, a frame core is formed, the center leg interconnecting two opposed frame sides along a longitudinal direction of the frame core, and the air gap extending through the center leg in a direction transversely to the longitudinal direction.

According to a further more advantageous embodiment thereof, the frame core additionally comprises two lateral leg parts which close the frame core, the lateral leg parts extending along the longitudinal direction straight or in an at least partially curved shape.

According to another more advantageous embodiment thereof, the center leg is spaced apart from each lateral leg part in a direction transversely to the longitudinal direction through at least one winding window having the shape of a rectangular parallelepiped or of a cylinder.

According to another more advantageous embodiment thereof, the air gap is molded at an angle other than 90° relative to the longitudinal direction of the center leg. An air gap having a larger contact area with respect to the center leg is thus provided, so that a smaller length of the air gap along the longitudinal direction can be chosen.

According to advantageous embodiments thereof, the air gap is molded-in as a gap having the shape of a prism, or as a gap having the shape of a roof. Air gaps, such as air gaps molded in the form of a prism, a wedge or a roof, lead to a non-linear L-I behavior of the core. A non-linear L-I behavior means that the inductance is not constant and decreases significantly and continuously with increasing current.

According to an advantageous embodiment, the air gap is molded-in by means of a material that is easy to remove. This allows easy formation of the air gap. Due to the easily removable material acting as a placeholder, the gap is subjected to small manufacturing tolerances during the production process, and the core is protected against damage.

According to an advantageous embodiment, the frame core comprises at least one further center leg, into which a further air gap is molded during the formation of the frame core. In this way, integral, one-piece frame cores comprising more than one center leg, which each have an air gap molded therein, are provided, without the necessity of gluing in core parts during the production process.

According to a further illustrative embodiment of the present invention, a frame core having a center leg and an air gap in the center leg is provided, wherein the frame core is integrally formed in one piece with the center leg and the air gap in the center leg.

According to an advantageous embodiment thereof, the frame core comprises two frame areas and two lateral leg parts interconnecting the frame areas along a longitudinal direction so as to form a closed core, wherein the center leg is spaced apart from each lateral leg part in a direction transversely to the longitudinal direction through at least one winding window having the shape of a rectangular parallelepiped or of a cylinder.

According to a further advantageous embodiment, the frame core comprises at least one further center leg which is formed integrally with the frame core.

SHORT DESCRIPTION OF THE FIGURES

Figure 2A:
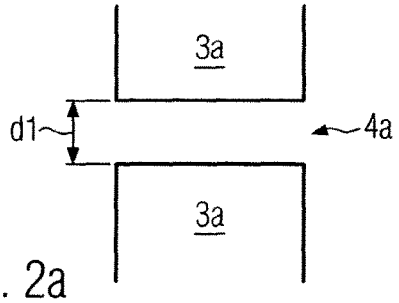
Figure 2B:
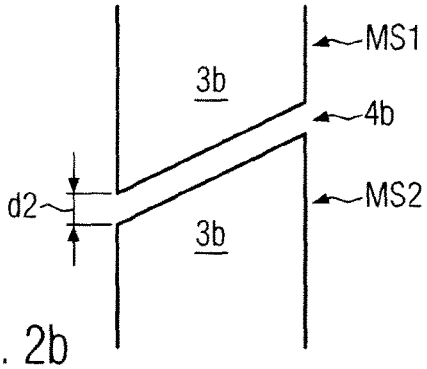
Figure 2C:
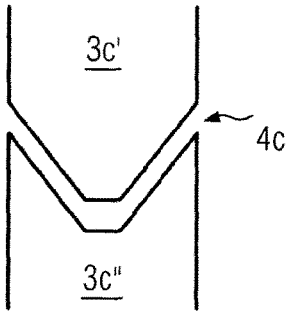
Figure 2D:
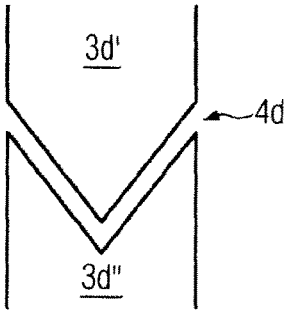
Figure 2E:
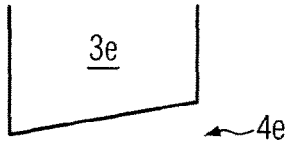
Figure 2E:
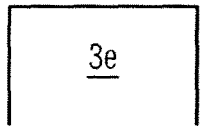
Figure 2F:
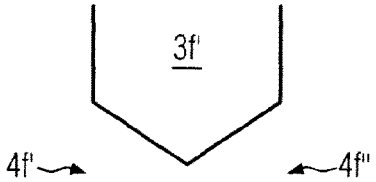
Figure 2F:
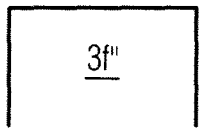
Figure 2G:
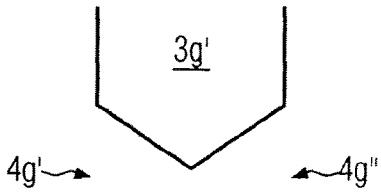
Figure 2G:
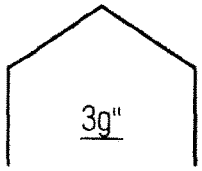

Further advantages can be seen from the description of illustrative embodiments, which is carried out in accordance with the figures enclosed, in which:

FIG. 1 shows schematically a frame core having a center leg and an air gap in the center leg according to an illustrative embodiment of the present invention;

FIG. 2*a* shows schematically a cross-sectional view of an air gap in the center leg according to some illustrative embodiments of the present invention;

FIG. 2*b* shows schematically a cross-sectional view of an air gap according to further illustrative embodiments of the present invention;

FIG. 2*c* shows schematically a cross-sectional view of an air gap according to further illustrative embodiments of the present invention;

FIG. 2*d* shows schematically a cross-sectional view of an air gap according to further illustrative embodiments of the present invention;

FIG. 2*e* shows schematically a cross-sectional view of an air gap according to further illustrative embodiments of the present invention;

FIG. 2*f* shows schematically a cross-sectional view of an air gap according to further illustrative embodiments of the present invention;

FIG. 2*g* shows schematically a cross-sectional view of an air gap according to further illustrative embodiments of the present invention; and FIGS. 3*a* to 3*e* show schematically cross-sectional views of frame cores according to alternative embodiments of the present invention.

DETAILED DESCRIPTION

The present invention provides generally a one-piece frame core comprising a middle bleb and an air gap formed in the middle bleb. According to the present invention, the frame core is formed in one piece in a compression mold, the air gap being incorporated in the middle bleb directly in the compression mold. On the one hand, this has the effect that gluing processes are avoided, such gluing processes being, according to the above statements, normally used in known closed core configurations defined by two E cores (so-called double-E core configurations) or by an E core with an I core (so-called E-I core configurations). Due to the fact that additional gluing processes are avoided, the expenditure of time in production is reduced and the costs for the production of such frame cores are kept low. On the other hand, frame cores according to the present invention exhibit, due to their one-piece structural design, a higher mechanical stability in comparison with composite core configurations, since the glued joints represent significant mechanically weak points at the finished core component. In addition, the grinding process can be dispensed with. Face grinding of the core back and of the lateral legs is normally a prerequisite for grinding the air gap precisely into the middle bleb and for precise field guidance. This process is expensive and it often leads to cores that are mechanically damaged in advance through splintering and cracks. The fact that the grinding process is no longer necessary leads to a substantial reduction of costs and to an improvement of the quality of the component. In addition, due to the production of frame cores having a center leg and an air gap molded therein in accordance with the present invention, tolerances in the magnetic characteristics are kept small, since e.g. glued joints, which represent in known cores magnetic resistances that are difficult to control, are no longer necessary. It follows that the present invention allows providing frame cores which observe predetermined magnetic characteristics within very close limits.

In the following, illustrative embodiments will be described exemplarily with reference to the figures enclosed.

A few illustrative embodiments of the present invention will be described in more detail hereinafter making reference to FIG. 1.

FIG. 1 shows schematically a frame core 1 in a perspective view. The frame core 1 consists of a frame part 2 and a center leg 3, said center leg 3 having formed therein an air gap 4. The frame part 2 comprises two lateral leg parts 2*c* extending, with respect to the center leg 3, along a longitudinal direction L of the center leg 3. The lateral leg parts 2*c* and the center leg 3 are interconnected along a width direction B, which is oriented perpendicular to the longitudinal direction L, by an upper crossbar part 2*a* and a lower crossbar part 2*b* at opposed sides of the lateral leg parts 2*c* and of the center leg 3. A depth dimension of the frame core 1 is schematically indicated in FIG. 1 by a depth direction T, which is oriented perpendicular to the longitudinal direction L and the width direction B.

According to a few illustrative embodiments of the present invention, the frame core 1 shown in FIG. 1 is formed from at least one soft-magnetic ferrite material. According to an illustrative example, the at least one soft-magnetic ferrite material is provided e.g. in the form of a nickel zinc ferrite material or a manganese zinc ferrite material.

In the case of the frame core 1 shown in FIG. 1, the individual core sections have rectangular cross-sections in a direction perpendicular to the longitudinal direction L. This does not limit the present invention. Alternatively, the center leg 3 and/or at least one of the lateral leg parts 2*c* and/or the upper crossbar part 2*a* and/or the lower crossbar part 2*b* may have a round or an oval cross-section in a direction perpendicular to the longitudinal direction L. Reference is made to the fact that the edges of the center leg 3 and/or of at least one of the lateral leg parts 2*c* and/or of the upper crossbar part 2*a* and/or of the lower crossbar part 2*b* may be rounded.

With respect to FIGS. 2*a* to 2*e*, different configurations of the air gap 4, which is schematically shown in FIG. 1, will be described hereinafter.

FIG. 2*a* shows a schematic representation of an air gap 4*a* according to a first embodiment in a side view. In order to simplify the representation, only an area of a center leg 3*a* around the air gap 4*a* is shown. The air gap 4*a* is arranged in the center leg 3*a* transversely to a longitudinal direction of the center leg 3*a* (cf. longitudinal direction L in FIG. 1). In particular, the air gap 4*a* according to the first embodiment is oriented perpendicular to the longitudinal direction of the center leg 3*a*. The center leg 3*a* may here exhibit a rectangular, rounded, oval or round cross-section in a direction perpendicular to the longitudinal direction (in particular in a plane along the depth and width directions T, B in FIG. 1). According to the representation shown in FIG. 2*a*, the air gap 4*a* has a length d1. The air gap 4*a* shown is oriented transversely to the longitudinal direction of the center leg 3*a*, so that the direction in which the air gap 4*a* extends through the center leg 3*a* is arranged perpendicular (approx. 90° with fault tolerance) to the longitudinal direction.

FIG. 2*b* shows an air gap 4*b* according to a second embodiment of the present invention in a side view perpendicular to a longitudinal direction in an area around the air gap 4*b* in the center leg 3*b*. The center leg 3*b* may here exhibit a rectangular, rounded, oval or round cross-section in a direction perpendicular to its longitudinal direction or in a plane oriented parallel to the directions B, T (cf. the longitudinal direction L in FIG. 1). According to the second embodiment shown in FIG. 2*b*, the air gap 4*b* is molded into the center leg 3*b* as an inclined plane and spaces apart an upper center leg part MS1 and a lower center leg part MS2 by a distance d2. In particular, the air gap 4*b* is oriented transversely to the longitudinal direction (cf. the longitudinal direction L in FIG. 1) of the center leg 3*b*. An angle at which the air gap 4*b* is oriented relative to the longitudinal direction L (cf. FIG. 1) is here different from 90°. In comparison with the air gap 4*a*, the air gap 4*b* has larger contact areas towards the center leg. The term contact areas stands here for the pole faces, which are exposed through the air gap 4*b* in the center leg and through which a magnetic flux density ("B field") existing in the center leg 4*b* enters the air gap 4*b* from a center leg part MS1 or MS2 and exits the air gap 4*b*. Due to the larger contact areas, the length d2 of the air gap 4*b* (measured as the distance d2 between the center leg parts MS1 and MS2 spaced apart by the air gap 4*b*, as shown in FIG. 2*b*) can be chosen smaller in comparison with the length d1 of the air gap 4*a* (d2<d1). According to some special embodiments, the length d2 of the air gap 4*b* is related to the size of the contact area or pole face in the air gap 4*b*; the length d2 of the air gap 4*b* may e.g. be indirectly proportional to the contact area or pole face in the air gap 4*b*, so that the length d2 of the air gap 4*b* will decrease as the size of the contact area or pole face increases, i.e. the angle between the contact areas or pole faces and the longitudinal direction decreases (an angle of 90° corresponds to the orientation of the gap 4*a* according to FIG. 2*a*).

An air gap 4*c* according to a third embodiment of the present invention is shown in FIG. 2*c* in a side view of a portion in the center leg around the air gap 4*c*. An upper center leg part 3*c*' has the shape of a prism or of a frustum of a pyramid or of a frustum of a cone. A lower center leg part 3*c*" is configured such that, when the two core parts 3*c*' and 3*c*" are combined, a gapless center leg is obtained, which has the shape of a rectangular parallelepiped or of a cylinder. In other words, the center leg part 3*c*" is provided with an indentation which is the negative of the center leg part 3*c*' that has the shape of a prism or of a frustum of a pyramid or of a frustum of a cone.

A fourth embodiment is schematically shown in a side view on the basis of an air gap 4*d*, the air gap 4*b* being molded into the center leg such that an upper center leg 3*d*' has the shape of a wedge or a pyramid or a cone. A lower center leg part 3*d*" is additionally configured such that, when the upper center leg part 3*d*' and the lower center leg part 3*d*" are combined, a gapless center leg is obtained, which has the shape of a rectangular parallelepiped or of a cylinder. In other words, the center leg part 3*d*" is provided with an indentation which is the negative of the center leg part 3*d*' that has the shape of a wedge or of a pyramid or of a cone.

A fifth embodiment of an air gap 4*e* is shown in FIG. 2*e*. The air gap 4*e* is here molded into the center leg 3*e* in a wedge shape.

The schematic cross-sectional view shown in FIG. 2*f* is a further development of the fifth embodiment shown in FIG. 2*e*. The air gap according to this further development is configured as a double wedge-shaped air gap provided by two wedge-shaped air gap areas 4*f*' and 4*f*" formed at opposed sides of the center leg. According to the representation in FIG. 2*f*, the center leg has an upper center leg part 3*f*' and a lower center leg part 3*f*' between which the double wedge-shaped air gap 4*f*', 4*f*" is arranged. The lower center leg part 3*f*" delimits the double wedge-shaped air gap 4*f*', 4*f*" by a contact area extending through the center leg in a direction transversely to the longitudinal direction (cf. reference symbol L in FIG. 1). In the example shown, the contact area of the lower center leg part 3*f*" is oriented in a direction perpendicular to the longitudinal direction. Alternatively, the contact area may be oriented relative to the longitudinal direction at an angle other than 90° (cf. L in FIG. 1); for example, the contact area may be provided by a bevel of the lower center leg part. The upper center leg part 3*f'* has a roof- or wedge-shaped contact area defining the double wedge-shaped air gap 4*f'*, 4*f"*. Alternatively, the contact area of the upper center leg part 3*f'* has the shape of a pyramid or of a cone.

FIG. 2*g* shows schematically in a cross-sectional view an alternative embodiment of a double wedge-shaped air gap 4*g'*, 4*g"*. The center leg comprises in an area surrounding the double wedge-shaped air gap 4*g'*, 4*g"* an upper center leg part 3*g'* and a lower center leg part 3*g"* between which the air gap is formed in the center leg. The upper center leg part 3*g'* and the lower center leg part 3*g"* each have a roof- or wedge-shaped contact area. Alternatively, the contact area of the upper center leg part 3*f'* has the shape of a pyramid or of a cone. In an illustrative example, the upper and lower center leg parts 3*g*, 3*g"* are configured such that they are symmetric with respect to one another, although this does not limit the present invention and asymmetric center leg parts are imaginable as well.

Through the different embodiments of the air gap molded into the center leg, which are shown in FIGS. 2*a* to 2*e*, a characteristic L-I behavior is achieved. By means of the air gap 4*a* according to FIG. 2*a*, an L-I profile is obtained, in the case of which the inductance L exhibits a substantially constant behavior up to a current $I_1$ (L varies in the range $I<I_1$ by less than 10%, preferably less than 5% or less than 1%) and decreases drastically when $I_1$ is exceeded. In the case of the embodiments shown according to FIGS. 2*b* to 2*e*, however, a decreasing L against I behavior is obtained, which deviates from that according to FIG. 2*a* by a substantially non-constant behavior.

Frame cores according to the present invention are formed in one piece in a compression mold, the air gap in the middle bleb being formed in the core directly within the compression mold. Production methods according to the present invention comprise in the case of a few illustrative embodiments a compression molding method, according to which the core material is filled into a cavity of a compression mold in powder form. The female die, the upper male die and the lower male die are here suitably configured for integrally forming the frame core with the center leg and the air gap provided in the center leg during a compression molding process. It is explicitly pointed out that the upper male die and the lower male die of the compression mold may consist of a plurality of individual dies, which are movable independently of one another. During or subsequent to the compression molding process, sintering may be effected by the action of heat. Alternatively, frame cores according to the present invention are produced in a ceramic injection molding process. According to a few special illustrative embodiments, an air gap is molded-in by means of a suitably configured partition, which, while the material is being filled into the cavity or after the material has been filled into the cavity, is arranged in the cavity between two areas of material forming the center leg.

Alternatively, the air gap is formed by a material which is easily removable in comparison with the material of the magnetic core and which is introduced between two areas of material while the cavity is being filled. A gap-forming material may e.g. be provided in the form of a plastic material, which, after the compression molding process, is removed from the molding, e.g. during a bake-out step or an etching step. For this purpose, the cavity is e.g. filled with the material of the magnetic core, so that a first area of material is formed in the cavity. Subsequently, the gap-forming material is filled onto the first area of material. This may comprise pre-molding processing steps so as to impart a desired shape to the gap-forming material, said shape corresponding to the shape of the air gap to be formed. Subsequently, a second area of material is formed on the gap-forming material by filling in the material of the magnetic core. In a subsequent compression molding process, a molding is produced, in which the gap-forming material is disposed between the first and the second area of material. The air gap is formed by removing the gap-forming material through the action of heat and/or the action of a suitable etchant.

As regards FIGS. 3*a* to 3*e*, schematic cross-sectional views of frame cores according to alternative embodiments of the invention are shown, which deviate from the frame core 1 schematically shown in FIG. 1.

FIG. 3 a shows schematically a frame core 10 comprising a center leg 13*a* and an air gap 14 in the center leg 13*a*. The frame core 10 additionally comprises frame areas 12*a* and 12*b*, which extend along a direction B and which are interconnected by two lateral leg parts 12*c* arranged at opposed ends of the frame areas 12*a* and 12*b* and extending along a longitudinal direction L. The longitudinal direction L extends transversely to direction B and, according to the example shown, it is oriented perpendicular thereto. The frame core 10 is closed through the frame areas 12*a*, 12*b* and the lateral leg parts 12*c*. External surfaces 16 of the frame areas 12*a*, 12*b* extend parallel to direction B.

The center leg 13*a* is spaced apart from the lateral leg parts 12*c* on either side in direction B by a respective winding window 15. At least one of the winding windows 15 may have provided therein a winding (not shown), which is arranged on the center leg 13*a* and/or on at least one of the lateral leg parts 12*c*. According to the example shown in FIG. 3*a*, the winding windows are rectangular in shape in the sectional view shown, i.e. the winding windows 15 have, with due regard to a depth perpendicular to the directions L and B, the shape of a rectangular parallelepiped. The air gap 14 interconnects the winding windows 15.

Figure 3A:
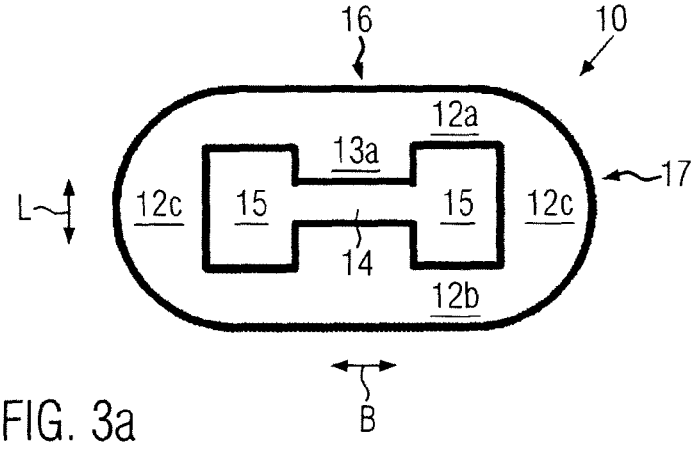

Other than the frame core 1 shown in FIG. 1, the frame core 10 according to FIG. 3*a* is shown with lateral leg parts 12*c* having rounded external surfaces 17. Thus, a magnetic field can be guided advantageously in the lateral leg parts. In addition, corners are avoided in the frame core 10.

Figure 3B:
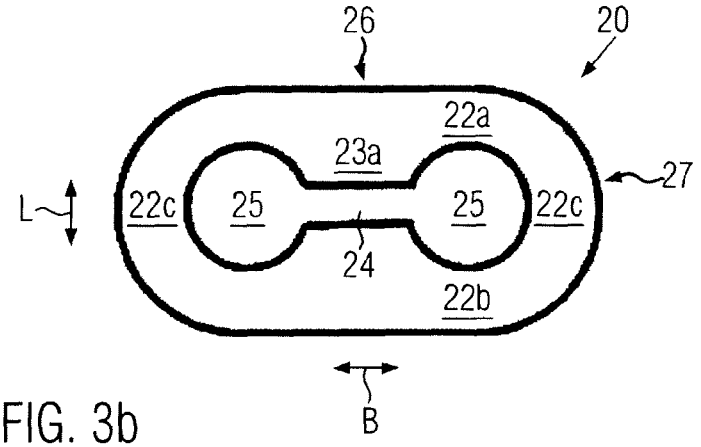

FIG. 3*b* shows schematically a frame core 20 comprising a center leg 23*a* and an air gap 24 in the center leg 23*a*. The frame core 20 additionally comprises frame areas 22*a* and 22*b*, which extend along a direction B and which are interconnected by two lateral leg parts 22*c* arranged at opposed ends of the frame areas 22*a* and 22*b* and extending along a longitudinal direction L. The longitudinal direction L extends transversely to direction B and, according to the example shown, it is oriented perpendicular thereto. The frame core 20 is closed through the frame areas 22*a*, 22*b* and the lateral leg parts 22*c*. External surfaces 26 of the frame areas 22*a*, 22*b* extend parallel to direction B.

The center leg 23*a* is spaced apart from the lateral leg parts 22*c* on either side in direction B by a respective winding window 25. At least one of the winding windows 25 may have provided therein a winding (not shown), which is arranged on the center leg 23*a* and/or on at least one of the lateral leg parts 22*c*. According to the example shown in FIG. 3*b*, the winding windows are circular in shape in the sectional view shown, i.e. the winding windows 25 have, with due regard to a depth perpendicular to the directions L and B, the shape of a cylinder in the frame core 20. The winding windows 25 are interconnected by the air gap 24.

Other than the frame core 1 shown in FIG. 1, the frame core 20 according to FIG. 3*b* is shown with lateral leg parts 22*c* having rounded external surfaces 27. Thus, a magnetic field can be guided advantageously in the lateral leg parts. In addition, corners are avoided in the frame core 20.

Figure 3C:
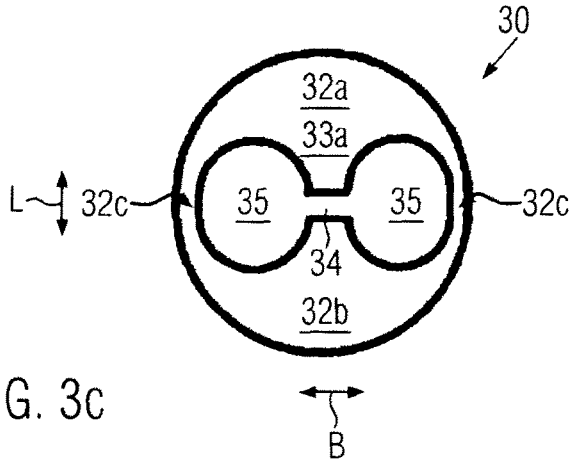

FIG. 3*c* shows schematically a frame core 30 comprising a center leg 33*a* and an air gap 34 in the center leg 33*a*. The frame core 30 additionally comprises frame areas 32*a* and 32*b*, which extend in a curved shape along a direction B and which are interconnected by two lateral leg parts 32*c* arranged at opposed ends of the frame areas 32*a* and 32*b* and extending in a curved shape along a longitudinal direction L. The longitudinal direction L extends transversely to direction B and, according to the example shown, it is oriented perpendicular thereto. The frame core 30 is closed through the frame areas 32*a*, 32*b* and the lateral leg parts 32*c*. External surfaces of the frame areas 32*a*, 32*b* are configured as curved surfaces.

The center leg 33*a* is spaced apart from the lateral leg parts 32*c* on either side in direction B by a respective winding window 35. At least one of the winding windows 35 may have provided therein a winding (not shown), which is arranged on the center leg 33*a* and/or on at least one of the lateral leg parts 32*c*. According to the example shown in FIG. 3*c*, the winding windows are circular in shape in the sectional view shown, i.e. the winding windows 35 have, with due regard to a depth perpendicular to the directions L and B, the shape of a cylinder in the frame core 30. The winding windows 35 are interconnected by the air gap 34.

Other than the frame core 1 shown in FIG. 1, the frame core 30 according to FIG. 3*c* is shown with lateral leg parts 32*c* having rounded external surfaces, so that a core configuration is provided, which, in its entirety, is cylindrical in shape. Thus, a magnetic field can be guided advantageously in the lateral leg parts. In addition, corners are avoided in the frame core 30.

Figure 3D:
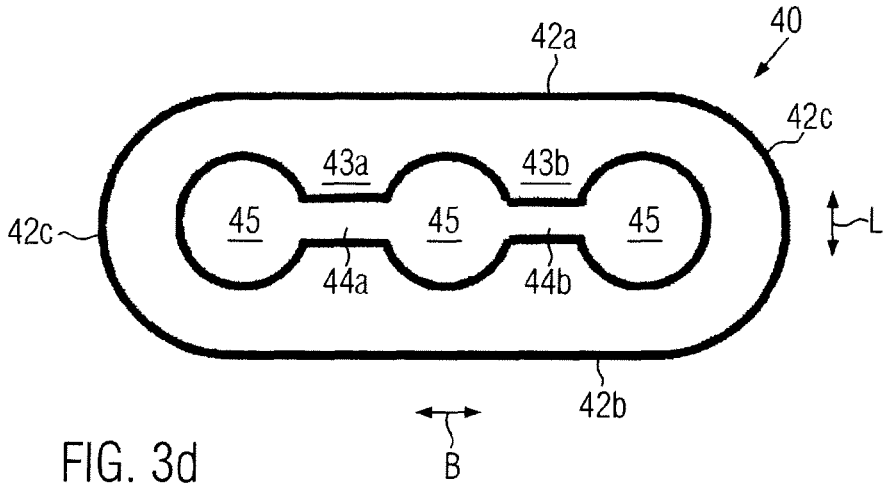

FIG. 3*d* shows a core configuration similar to that of FIG. 3*b*. What is here schematically shown is a frame core 40 comprising two center legs 43*a*, 43*b* having each an air gap 44*a*, 44*b* formed therein. The frame core 40 additionally comprises frame areas 42*a* and 42*b*, which extend parallel to a direction B and which are interconnected by two lateral leg parts 42*c* arranged at opposed ends of the frame areas 42*a* and 42*b* and extending along a longitudinal direction L. The longitudinal direction L extends transversely to direction B and, according to the example shown, it is oriented perpendicular thereto. The frame core 40 is closed through the frame areas 42*a*, 42*b* and the lateral leg parts 42*c*. External surfaces of the frame areas 42*a*, 42*b* are rounded.

Each center leg 43*a*, 43*b* is spaced apart from the lateral leg parts 42*c* on either side in direction B by one or a plurality of winding windows 45. At least one of the winding windows 45 may have provided therein a winding (not shown), which is arranged on at least one of the center legs 43*a*, 43*b* and/or on at least one of the lateral leg parts 42*c*. According to the example shown in FIG. 3*d*, the winding windows are circular in shape in the sectional view shown, i.e. the winding windows 35 have, with due regard to a depth perpendicular to the directions L and B, the shape of a cylinder in the frame core 40. The winding windows 45 are interconnected by the air gaps 44*a*, 44*b*.

Other than the frame core 1 shown in FIG. 1, the frame core 40 according to FIG. 3*d* is shown with lateral leg parts 42*c* having rounded external surfaces. Thus, a magnetic field can be guided advantageously in the lateral leg parts. In addition, corners are avoided in the frame core 40. Furthermore, frame core 40 differs from frame core 1 insofar as more than one center leg, in this case the center legs 43*a*, 43*b*, are provided, each of said center legs having formed therein a respective air gap 44*a*, 44*b*.

Figure 3E:
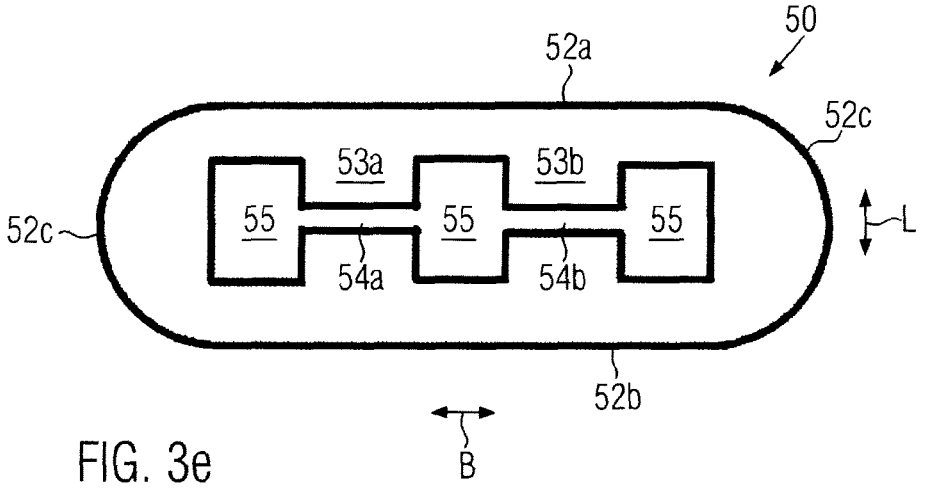

FIG. 3*e* shows a core configuration similar to that of FIG. 3*a*. What is here schematically shown is a frame core 50 comprising two center legs 53*a*, 53*b* having each an air gap 54*a*, 54*b* formed therein. The frame core 50 additionally comprises frame areas 52*a* and 52*b*, which extend parallel to a direction B and which are interconnected by two lateral leg parts 52*c* arranged at opposed ends of the frame areas 52*a* and 52*b* and extending along a longitudinal direction L. The longitudinal direction L extends transversely to direction B and, according to the example shown, it is oriented perpendicular thereto. The frame core 50 is closed through the frame areas 52*a*, 52*b* and the lateral leg parts 52*c*. External surfaces of the frame areas 52*a*, 52*b* are rounded.

Each center leg 53*a*, 53*b* is spaced apart from the lateral leg parts 52*c* on either side in direction B by one or a plurality of winding windows 55. At least one of the winding windows 55 may have provided therein a winding (not shown), which is arranged on at least one of the center legs 53*a*, 53*b* and/or on at least one of the lateral leg parts 52*c*. According to the example shown in FIG. 3*e*, the winding windows are rectangular in shape in the sectional view shown, i.e. the winding windows 55 have, with due regard to a depth perpendicular to the directions L and B, the shape of a rectangular parallelepiped in the frame core 50. The winding windows 55 are interconnected by the air gaps 54*a*, 54*b*.

Other than the frame core 1 shown in FIG. 1, the frame core 50 according to FIG. 3*e* is shown with lateral leg parts 52*c* having rounded external surfaces. Thus, a magnetic field can be guided advantageously in the lateral leg parts. In addition, corners are avoided in the frame core 50. Furthermore, frame core 50 differs from frame core 1 insofar as more than one center leg, in this case the center legs 53*a*, 53*b*, are provided, each of said center legs having formed therein a respective air gap 54*a*, 54*b*.

According to further illustrative embodiments of the present invention, each of the air gaps in FIGS. 3*a* to 3*e* may be configured in accordance with one of the air gaps described with respect to FIGS. 2*a* to 2*g*.

Summarizing, the present invention provides a method of forming a frame core having a center leg for an inductive component, and an accordingly formed frame core having a center leg and an air gap in the center leg. The frame core is formed integrally with the center leg, the air gap being molded into the center leg during the formation of the frame core.

What is claimed is:

1. A method for forming a frame core having a center leg for an inductive component, wherein the frame core is formed integrally with the center leg, and wherein an air gap is molded into the center leg during the formation of the frame core.

2. The method according to claim 1, wherein the frame core having a center leg is formed in a ceramic injection molding process.

3. The method according to claim 1, wherein the frame core having a center leg is formed in a compression molding process.

4. The method according to claim 1, wherein the center leg interconnects two frame areas along a longitudinal direction, and the air gap extends through the center leg in a direction transversely to the longitudinal direction.

5. The method according to claim 4, wherein the frame core additionally comprises two lateral leg parts which close the frame core, wherein the lateral leg parts extend along the longitudinal direction straight or in an at least partially curved shape.

6. The method according to claim 5, wherein the center leg is laterally spaced apart from each lateral leg part through at least one winding window having a shape of a rectangular parallelepiped or of a cylinder.

7. The method according to claim 4, wherein the air gap is molded-in at an angle other than 90° relative to the longitudinal direction.

8. The method according to claim 1, wherein the air gap is molded-in as an air gap having the shape of a prism, or as an air gap having the shape of a roof or of a pyramid, or as a wedge-shaped air gap, or as a double wedge-shaped air gap.

9. The method according to claim 1, wherein the frame core is formed of at least one ferrite material.

10. The method according to claim 1, wherein the air gap is molded-in by a partition corresponding to the air gap.

11. The method according to claim 1, wherein the air gap is molded in by a removable material.

12. The method according to claim 1, wherein the frame core comprises at least one further center leg, into which a further air gap is molded during the formation of the frame core.

13. A method of forming a core for an inductive component comprising the step of:

molding an integral one-piece frame core having an upper and a lower cross bar with opposing portions of a center leg extending from a respective one of the upper and lower cross bars, the opposing portions of the center leg forming a gap adjacent distal ends of the opposing portions, whereby the integral frame core is strong, mechanically stable, and efficiently produced.

* * * * *